United States Patent [19]

Ikeda et al.

[11] 4,436,803

[45] Mar. 13, 1984

[54] METHOD OF DEVELOPING ELECTROSTATIC IMAGE WITH MAGNETIC BRUSH EAR PROMOTER

[75] Inventors: Toshimitsu Ikeda, Himeji; Nobuyasu Honda, Tenri; Tetsuya Nakano, Osaka, all of Japan

[73] Assignee: Mita Industrial Co., Ltd., Osaka, Japan

[21] Appl. No.: 360,938

[22] Filed: Mar. 23, 1982

[30] Foreign Application Priority Data

Mar. 23, 1981 [JP] Japan ..... 56-40424

[51] Int. Cl.[3] ..... G03G 9/14; G03G 13/09

[52] U.S. Cl. ..... 430/122; 430/106.6; 118/657; 118/658

[58] Field of Search ..... 430/106.6, 122; 118/657, 658

[56] References Cited

U.S. PATENT DOCUMENTS

| | | | |
|---|---|---|---|
| 2,846,333 | 8/1958 | Wilson | 430/109 X |
| 4,030,447 | 6/1977 | Takahashi et al. | 118/658 |
| 4,142,981 | 3/1979 | Bean et al. | 430/109 |
| 4,165,393 | 8/1979 | Suzuki et al. | 430/122 |
| 4,292,921 | 10/1981 | Kroll et al. | 118/658 X |
| 4,309,498 | 1/1982 | Yamashita et al. | 430/100 |
| 4,331,757 | 5/1982 | Tayaka et al. | 430/107 X |

FOREIGN PATENT DOCUMENTS

| | | | |
|---|---|---|---|
| 53-118054 | 1/1978 | Japan | 430/106.6 |
| 56-16145 | 2/1981 | Japan | 430/106.6 |

*Primary Examiner*—Roland E. Martin, Jr.
*Attorney, Agent, or Firm*—Sherman & Shalloway

[57] ABSTRACT

Disclosed is a method of developing an electrostatic image by bringing an electrostatic image-carrying surface of a substrate into sliding contact with a magnetic brush of a developer formed on a developer-feeding sleeve having a magnet arranged in the interior thereof, wherein the magnetic brush is formed from an earing-promoting component comprising particles of a dispersion of a powder of a magnetic material in a resin, which have a relatively large diameter of 70 to 300 microns, and a developer component comprising particles of a dispersion of a powder of a magnetic material in a binder medium, which have a relatively small diameter of 5 to 50 microns.

9 Claims, 6 Drawing Figures

METHOD OF DEVELOPING ELECTROSTATIC IMAGE WITH MAGNETIC BRUSH EAR PROMOTER

BACKGROUND OF THE INVENTION

1. Field of the Invention

The present invention relates to a method of the development of an electrostatic image. More particularly, the present invention relates to an improvement in the development of an electrostatic image with a magnetic brush of a magnetic developer, in which earing of a magnetic brush is highly improved.

2. Description of the Prior Art

As the conventional developer for use in developing an electrostatic image with a magnetic brush, there can be mentioned two types of developers, that is, a two-component type developer comprising a mixture of a fixable electroscopic powder (toner) and a magnetic carrier and a one-component type developer comprising particles formed by shaping a dispersion of a powder of a magnetic material in a fixing binder medium.

In the two-component type developer, it is indispensable that toner particles should be charged by friction between the magnetic carrier and the toner, and the two-component type developer is defective in that a good image cannot be obtained unless the mixing ratio of the magnetic carrier to the toner is within a certain range. Moreover, while the two-component type developer is used for a long time, the toner or a component of the toner is accumulated on the surface of the magnetic carrier (ordinarily called "spent toner") and charging of the toner becomes difficult.

The one-component type developer is advantageous in that development is possible without a trouble of the use of the magnetic carrier which is indispensable for the two-component type developer. However, when the one-component type developer is used, earing of the magnetic brush is considerably changed according to changes of environmental conditions such as the temperature and the humidity, and it often is difficult to keep the amount of the ear of the magnetic brush constant. More specifically, in case of the one-component type magnetic developer, the ear of the magnetic brush is formed of the developer per se, and since earing is effected while developer particles are being moved on a development sleeve with rotation of the development sleeve or rotation of a magnet arranged in the development sleeve, if the flowability of the developer (which is changed according to changes of environmental conditions) is changed, the amount of the ear is changed.

SUMMARY OF THE INVENTION

We found that when a magnetic brush is formed on a sleeve from an earing-promoting component comprising particles of a dispersion of a powder of a magnetic material in a resin, which have a relatively large diameter of 70 to 300 microns, and a developer component comprising particles of a powder of a magnetic material in a binder medium, which have a relatively small diameter of 5 to 50 microns, good earing of a magnetic brush can be maintained even if environmental conditions are changed and an image having a high density and a good quality can be obtained even if the concentration of the developer component is drastically changed.

In accordance with the present invention, there is provided a method of developing an electrostatic image by bringing an electrostatic image-carrying surface of a substrate into sliding contact with a magnetic brush of a developer formed on a developer-feeding sleeve having a magnet arranged in the interior thereof, wherein the magnetic brush is formed from an earing-promoting component comprising particles of a dispersion of a powder of a magnetic material in a resin, which have a relatively large diameter of 70 to 300 microns, and a developer component comprising particles of a dispersion of a powder of a magnetic material in a binder medium, which have a relatively small diameter of 5 to 50 microns.

DETAILED DESCRIPTION OF THE PREFERRED EMBODIMENTS

Figure 1:
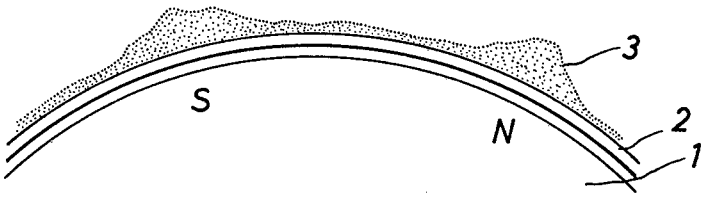
FIG. 1 is a diagram illustrating earing of the conventional one-component type magnetic developer.

According to the conventional magnetic brush development method, as shown in FIG. 1, a magnetic developer 3 is supplied on a developer-feeding sleeve 2 provided with a magnet 1, and developer particles are rotated and moved on the surface of the sleeve and a magnetic brush is formed by earing at a position corresponding to a magnetic pole N or S.

Figure 2:
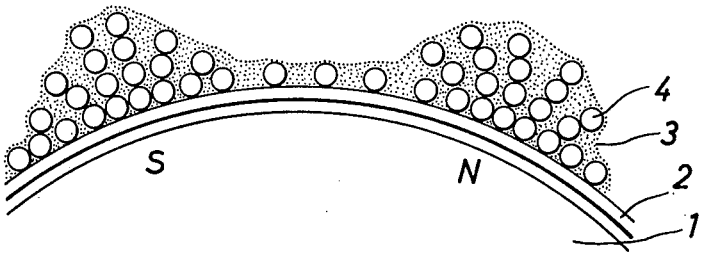
FIG. 2 is a diagram illustrating earing of the developer of the present invention comprising an earing-promoting component and a magnetic developer component.

One of important features of the present invention is that, as shown in FIG. 2, a magnetic brush is formed from a developer component 3 comprising particles of a dispersion of a powder of a magnetic material of a binder medium, which have a relatively small diameter of 5 to 50 microns, in combination with an earing-promoting component 4 comprising particles of a dispersion of a powder of a magnetic material in a resin, which have a relatively large diameter of 70 to 300 microns.

The large-diameter earing-promoting component 4 that is used in the present invention is distinguishable over the small-diameter developer component in that it has such a magnetic property that earing of the magnetic brush on the sleeve is improved. When the magnetic developer particles are delivered on the sleeve, as described hereinbefore, the developer particles are moved on the sleeve while being rotated to form a magnetic brush. Since the earing-promoting component 4 that is used in the present invention has a particle size larger than that of the developer component 3, the moving speed of the earing-promoting component 4 on the sleeve is higher than that of the developer component 3, and therefore, a sufficient stirring effect is given to the developer component on the sleeve. Since the magnetic developer contains a binder medium, when the temperature is elevated, the flowability of the magnetic developer is reduced and blocking often takes place. Reduction of the flowability or occurrence of blocking results in reduction of the amount eared of the magnetic brush and hence, reduction of the image quality, such as blurring or streaking, is caused. Such undesirable phenomenon as reduction of the flowability or blocking is similarly caused by elevation of the temperature and dewing on the surfaces of developer particles. According to the present invention, since a stirring action caused by the high-speed movement of the earing-promoting component is always given to the developer component on the sleeve, the developer component is always maintained in the form of a flowable powder irrespectively of changes of environmental conditions such as the temperature and the humidity, whereby good earing of the magnetic brush is always attained and reduction of the image quality, such as blurring or streaking, can be controlled.

The developer that is used in the present invention is distinguishable over the conventional two-component type magnetic developer in that the developer component, that is, the toner, comprises particles of a dispersion of a magnetic powder in a binder medium and also is distinguishable over the conventional magnetic toner in that the earing-promoting component comprises particles of a dispersion of a powder of a magnetic material in a resin.

The developer component that is used in the present invention, like the conventional one-component magnetic developer, performs development with a balance between the magnetic attractive force onto the sleeve and the electrostatic attractive force (Coulomb force) on the electrostatic image, and the developer component that is used in the present invention is therefore distinguishable over the conventional two-component type developer in the developing function in that the threshold value of the development is determined irrespectively of the earing-promoting component or the carrier component. Accordingly, even if the weight ratio of the earing-promoting component to the developer component is changed within a broad range of from 80/20 to 10/90, especially from 65/35 to 20/80, the density of the formed image can be maintained at a substantially constant level. This is another important feature of the present invention.

Table 1 given below illustrates the relation between the concentration of the developer component and the image density, which was observed when the weight ratio of the earing-promoting component to the developer component was changed in Example 4 given after.

TABLE 1

| Relation between Concentration of Developer Component and Image Density | | |
|---|---|---|
| Run No. | Ratio (% by weight) of Developer Component | Image Density |
| 1 | 10 | 0.60 |
| 2 | 20 | 1.14 |
| 3 | 30 | 1.45 |
| 4 | 40 | 1.50 |

TABLE 1-continued

| Relation between Concentration of Developer Component and Image Density | | |
|---|---|---|
| Run No. | Ratio (% by weight) of Developer Component | Image Density |
| 5 | 50 | 1.52 |
| 6 | 60 | 1.49 |
| 7 | 70 | 1.55 |
| 8 | 80 | 1.53 |
| 9 | 90 | 1.50 |

In order to obtain an image having high density and good quality, it is important that the earing-promoting component should be made up of particles of a dispersion of powder of a magnetic material in a resin. More specifically, if the earing-promoting component is formed of iron powder or magnetite ($Fe_3O_4$) alone as in case of the conventional magnetic carrier, reduction of the image density or quality is caused by leakage of charges of the electrostatic image. Practically, in case of a two-component type magnetic developer including an iron powder carrier, even if the toner concentration is considerably high, it often happens that a white fine brush-like blank portion called "brush mark" is formed in the resulting image. In the present invention, since particles of the earing-promoting component are composed of a dispersion of a powder of a magnetic material in a resin, leakage of charges of the electrostatic image can be prevented and therefore, the image density or quality can be enhanced. The particle size of the earing-promoting component can easily be adjusted by dispersing the magnetic material powder in a resin and granulating the resulting dispersion.

In the present invention, it also is important that the particle size of the earing-promoting component should be in the range of from 70 to 300$\mu$. If the particle size of the earing-promoting component is too small and below the above range, no substantial earing-promoting effect can be attained, and if the particle size of the earing-promoting component is too large and exceeds the above range, the image quality is reduced because the image density is not uniform. An earing-promoting component preferably used in the present invention is obtained by dispersing a powder of a magnetic material in a resin while using the magnetic material powder in an amount of 30 to 80% by weight based on the sum of the resin and the magnetic material powder and shaping the dispersion into particles. If the amount of the magnetic material powder is too small and below the above range, the magnetic characteristic is insufficient and the earing-promoting component per se is transferred to the electrostatic image. If the amount of the magnetic material powder is too large, leakage of charges of the electrostatic image is caused and the particles of the earing-promoting component are changed by dielectric polarization and are moved toward the electrostatic image. It is preferred that the electric resistivity of the earing-promoting component that is used in the present invention be in the range of from $10^7$ to $10^{14}$ $\Omega$-cm, though the preferred resistivity is changed to some extent according to the content of the magnetic material powder.

In the present invention, as the magnetic material powder, there can be used powders of triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$), and iron powder (Fe), cobalt powder (Co) and nickel powder (Ni). Among these magnetic materials, triiron tetroxide (magnetite) is especially preferred. It is preferred that the particle size of the magnetic material powder be in the range of from 0.05 to 5 microns.

Any of electrically insulating resins can be used as the resin in the present invention. Either a thermoplastic resin or an uncured thermosetting resin or its precondensate may be used. As the valuable natural resin, there can be mentioned balsam, rosin, shellac and copal, which may be modified with at least one member selected from vinyl resins, acrylic resins, alkyd resins, phenolic resins, epoxy resins and oleoresins described hereinafter. As the synthetic resin, there can be mentioned, for example, vinyl resins such as vinyl chloride resins, vinylidene chloride resins, vinyl acetate resins, vinyl acetal resins, e.g., polyvinyl butyral and vinyl ether polymers, acrylic resins such as polyacrylic acid esters, polymethacrylic acid esters, acrylic acid copolymers and methacrylic acid copolymers, polyethylene, polypropylene, styrene resins such as polystyrene, hydrogenated styrene resins, polyvinyl toluene and styrene copolymers, polyamide resins such as nylon-12, nylon-6 and polymeric fatty acid-modified polyamides, polyesters such as polyethylene terephthalate/isophthalate and polytetramethylene terephthalate/isophthalate, alkyd resins such as phthalic acid resins and maleic acid resins, phenol-formaldehyde resins, ketone resins, coumarone-indene resins, terpene resins, amino resins such as urea-formaldehyde resins and malamine-formaldehyde resins, and epoxy resins. These synthetic resins may be used in the form of a mixture of two or more of them, for example, a mixture of a phenolic resin and an epoxy resin or a mixture of an amino resin and an epoxy resin.

In order to adjust the electric resistivity of the earing-promoting component, carbon black, silica, zinc oxide or titanium oxide may be used in combination with the above-mentioned resin.

Granulation can be easily accomplished by melt-kneading the foregoing components and cooling and pulvering the kneaded mixture. Furthermore, a granulation product can also be prepared by dispersing the magnetic material powder in a resin solution and spray-granulating the dispersion. The shape of the particles may be spherical or amorphous, or the particles may have an amorphous shape having corners rounded more or less.

The developer component that is used in the present invention comprises particles of a dispersion of a powder of a magnetic material in a binder medium, which have a particle size of 5 to 50 microns, and the developer component can be prepared according to the known recipe and preparation process adopted for known one-component type magnetic developers.

As the binder medium, there can be used resins mentioned above with reference to the earing-promoting component, so far as they show a fixing property under application of heat or pressure. Furthermore, there may be used waxes as the binder medium. As a preferred fixing resin, there can be mentioned homopolymers and copolymers of vinyl aromatic monomers, especially monomers represented by the following formula:

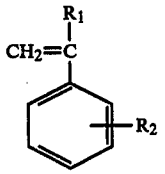

wherein $R_1$ stands for a hydrogen atom or a lower alkyl group, and $R_2$ stands for a hydrogen atom or a lower alkyl group, such as styrene, α-methylstyrene and vinyl toluene, and acrylic monomers such as acrylic acid, methacrylic acid, and esters and amides thereof.

As the preferred wax, there can be mentioned, for example, waxes in a narrow sense such as carnauba wax, cotton wax, candelilla wax, cane sugar wax, bees wax and wool wax, mineral waxes such as montan wax, paraffin wax and microcrystalline wax, solid higher fatty acids such as palmitic acid, stearic acid, hydroxystearic acid and behenic acid, amides of higher fatty acids having 16 to 22 carbon atoms (by the term "higher" used herein is meant "having 16 to 22 carbon atoms") such as oleic acid amide, stearic acid amide, palmitic acid amide, N-hydroxyethyl-hydroxystearoamide, N,N'-ethylene-bis-stearoamide, N,N'-ethylene-bis-licinolamide and N,N'-ethylene-bis-hydroxystearylamide, alkali metal, alkaline earth metal, zinc, aluminum and other metal salts of higher fatty acids such as calcium stearate, aluminum stearate, magnesium stearate and calcium palmitate, hydrazides of higher fatty acids such as palmitic acid hydrazide and stearic acid hydrazide, p-hydroxyanilides of higher fatty acids such as myristic acid p-hydroxyanilide and stearic acid p-hydroxyanilide, β-diethylaminoethyl ester hydrochlorides of higher fatty acids such as β-diethylaminoethyl laurate hydrochloride and β-diethylaminoethyl stearate hydrochloride, higher fatty acid amide-formaldehyde condensates such as stearic acid amide-formaldehyde condensates and palmitic acid amide-formaldehyde condensates, salt-forming reaction products between dyes or dye bases having an amino group and higher fatty acids in amounts of at least 4 moles per mole of said dyes or dye bases, such as a salt-forming reaction product between stearic acid, palmitic acid or myristic acid and a dye or dye base, hardened oils such as hardened castor oil and hardened beef tallow oil, and polyethylene wax, polypropylene wax and oxidized polyethylene, though waxes that can be used in the present invention are not limited to those exemplified above.

Magnetic material powders mentioned above with reference to the earing-promoting component can be used for the developer component. It is preferred that the amount of the magnetic material powder in the particles of the developer component be 40 to 75% by weight based on the sum of the binder medium and the magnetic material powder.

The developer component of the present invention may be used in the form of a so-called electroconductive magnetic developer. In this case, a conducting agent such as carbon black is incorporated in the particles of the developer component or a conducting agent such as carbon black is sprinkled or embedded on or in the surfaces of the particles of the developer component, so that the electric resistivity of the developer component is in the range of $10^4$ to $10^{12}$ Ω-cm. In case of this electroconductive developer component, charging of the particles of the developer component is accomplished by dielectric polarization and then, development is effected.

The developer component of the present invention may be used in the form of a so-called insulating magnetic developer. In this case, the electric resistivity is controlled to at least $10^{13}$ Ω-cm. In this developer component, if desired, a known negative or positive charge controlling agent may be blended.

Each of the above-mentioned two types of developer components can be granulated in the same manner as described above with reference to the earing-promoting component except that the particle size is adjusted to 5 to 50 microns.

In the present invention, as described hereinbefore, the earing-promoting component and the developer component may be present on the sleeve at a weight ratio of from 80/20 to 10/90, especially from 65/35 to 20/80. In the present invention, the earing component may always be held on the sleeve without separation therefrom, or it may once be separated from the sleeve and then supplied thereonto. In the former case, only the developer component is charged into a developer vessel and this developer component is supplied onto the sleeve, and the same developer-supplying operation as adopted in case of an ordinary one-component type magnetic developer is sufficient. Accordingly, the operation can be facilitated. In the latter case, since mixing of the earing-promoting component with the developer component is performed also in the developer vessel, the effects of improving the flowability and preventing occurrence of blocking can further be enhanced.

In accordance with one preferred embodiment of the present invention, there is provided a method of the development of an electrostatic image, which comprises arranging a developer-feeding sleeve having a magnet arranged in the interior thereof between the surface of a photosensitive drum carrying an electrostatic image thereon and a developer vessel for containing a developer therein, forming a magnetic brush on the sleeve from an earing-promoting component comprising particles of a dispersion of a powder of a magnetic material in a resin, which have a relatively large diameter of from 70 to 300 microns, and a developer component comprising particles of a dispersion of a powder of a magnetic material in a binder medium, which have a relatively small diameter of from 5 to 50 microns, and rotating the magnet arranged in the interior of the sleeve.

In this embodiment, the sleeve per se may be stopped or rotated.

Figure 3:
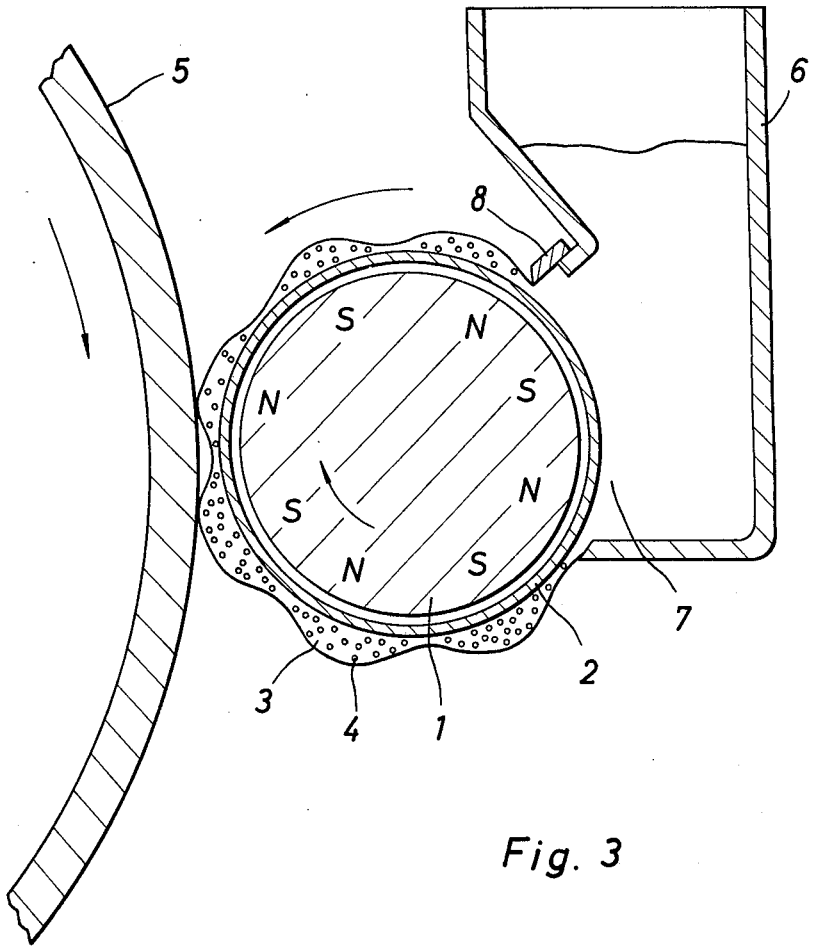
FIG. 3 is a diagram illustrating an embodiment in which the developer of the present invention comprising an earing-promoting component and a developer component is used for a developing apparatus in which a sleeve is fixed and a magnet is rotated.

Referring to FIG. 3 illustrating the former modification, a developer-feeding sleeve 2 provided with a magnet 1 is arranged between the surface of a photosensitive drum 5 carrying an electrostatic image thereon and a vessel 6 for containing a developer therein.

As shown in FIG. 3, the magnet 1 has a symmetric multi-polar structure in which poles S and N are arranged alternately along the inner circumference of the sleeve, and the sleeve 2 is made stationary but the magnet 1 is rotatably arranged in the interior of the sleeve 2.

Referring to FIG. 3, the photosensitive drum 5 is rotated in the clockwise direction and the magnet 1 is rotated in the same direction, that is, in the clockwise direction. With rotation of the magnet 1, the earing-promoting component 4 and the developer component 3 are moved in the direction opposite to the rotation direction of the magnet 1 while being rotated along the surface of the sleeve, and according to the mechanism described hereinbefore, good earing can be attained and the electrostatic image on the photosensitive drum 5 is brought into contact with the magnetic brush and developed with the developer component 3. Incidentally, an ear-cutting plate 8 is arranged on the magnetic brush-feeding side of an opening 7 of the developer vessel 6 to adjust the earing quantity.

In this embodiment of the present invention, a prominent advantage described below can be attained by performing feeding of the developer by rotation of the magnet. More specifically, in order to feed the developer while keeping the magnet 1 stationary, it is necessary to rotate the sleeve 2, and in this case, however, phase separation is caused in the homogeneous mixture of the earing-promoting component and the developer component and earing on the sleeve becomes irregular. In contrast, if the magnet is rotated according to this embodiment of the present invention, homogeneous mixing can always be maintained on the sleeve between the earing-promoting component and the developer component and earing on the sleeve can always be kept uniform.

The reason has not been elucidated sufficiently. However, it has been confirmed that when the sleeve is rotated but the magnet is kept stationary, the movement of the earing-promoting component is a regular movement such as a vertical movement, a sidelong falling movement or a handstanding movement, while when the magnet is rotated, irregular movements such as rotation are caused among the above-mentioned regular movements and mingling of the earing-promoting component with the developer component is performed more effectively. It is believed that the above advantage will probably be attained for this reason. Furthermore, when the magnet is kept stationary, influences of the non-uniformity of the magnetic force are considerably serious, while when the magnet is rotated, the influences of the non-uniformity of the magnetic force is moderated. It is considered that this may be another reason of the above advantage.

In the present embodiment of the present invention, by rotating the magnet 1 in the same direction as the rotation direction of the photosensitive drum, the movement of the magnetic brush can be smoothened in the portion where the magnetic brush falls in contact with the photosensitive drum.

The moving speed of the photosensitive drum is 20 to 60 rotations per minute, while the rotation speed of the magnet is 500 to 1000 rotations per minute.

Figure 4:
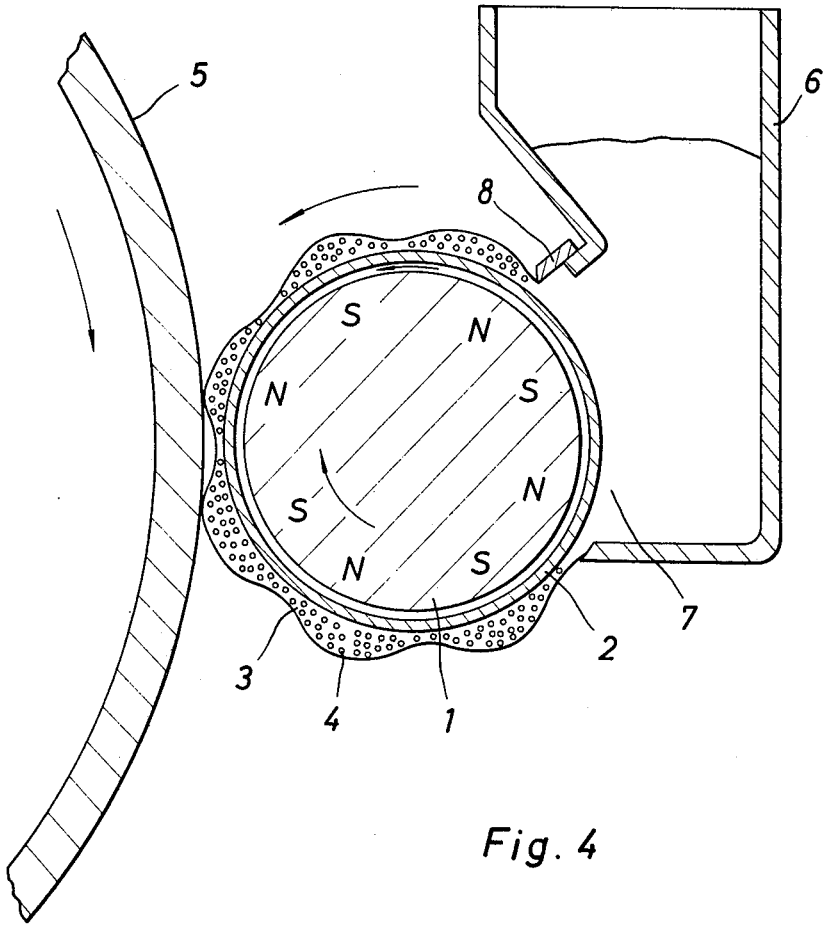
FIG. 4 is a diagram illustrating an embodiment in which the developer of the present invention comprising an earing-promoting component and a developer component is used for a developing apparatus in which a magnet and a sleeve are rotated.

Referring to FIG. 4 illustrating the embodiment in which both the magnet and the sleeve are rotated, the sleeve 2 is rotatably arranged, and the sleeve 2 is rotated in the direction opposite to the rotation direction of the magnet 1, that is, in the counterclockwise direction, whereby the moving speed of the developer as a whole can be increased. More specifically, since the difference of the moving speed between the earing-promoting component 4 and the developer component 3 is increased, the stirring action is enhanced, and the state of earing of the magnetic brush is further improved and earing is further uniformalized. In this embodiment, the rotation speed of the magnet 1 is 500 to 1000 rotations per minute and the rotation speed of the sleeve 2 is 100 to 400 rotations per minute.

In accordance with another embodiment of the present invention, there is provided a method of the development of an electrostatic image, which comprises arranging a developer-feeding sleeve having a magnet arranged in the interior thereof between the surface of a photosensitive drum carrying an electrostatic image thereon and a developer vessel for containing a developer therein, forming a magnetic brush on the sleeve from an earing-promoting component comprising particles of a dispersion of a powder of a magnetic material in a resin, which have a relatively large diameter of 70 to 300 microns, and a developer component comprising particles of a dispersion of a powder of a magnetic material in a binder medium, which have a relatively small diameter of 5 to 50 microns, rotating the sleeve, and arranging an asymmetric magnet in which poles S and N are alternately arranged on the inner circumference of the sleeve and poles S or N are arranged adjacently to each other at a position other than the developer-feeding portion, stationarily within the sleeve.

Figure 5:
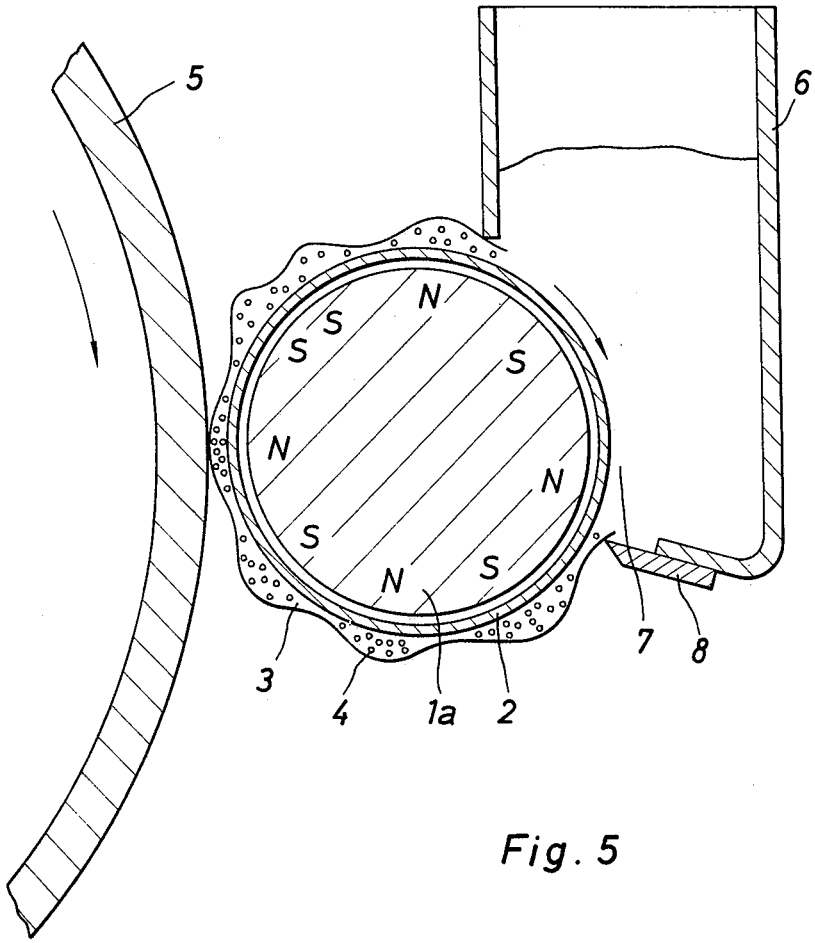
FIG. 5 is a diagram illustrating an embodiment in which the developer of the present invention comprising an earing-promoting component and a developer component is used for a developing apparatus in which an asymmetric multi-polar magnet is arranged.

This embodiment is illustrated in FIG. 5. The arrangement of the respective members is substantially the same as in the embodiment shown in FIG. 3, but the embodiment shown in FIG. 5 is different from the embodiment shown in FIG. 3 in that a magnet 1*a* is arranged stationarily and a sleeve 2 is rotatably arranged. This magnet 1*a* has an asymmetric structure in which poles S and N are arranged alternately along the inner circumference of the sleeve and poles S or N are arranged adjacently to each other in a portion other than the developer-feeding portion 7.

As pointed out hereinbefore, in the case where the magnet is arranged stationarily and the sleeve is rotated, phase separation is caused between the earing-promoting component 4 and the developer component 3, and earing becomes irregular. In this embodiment of the present invention, in contrast, flying of the earing-promoting component between the adjacent poles S or N or isolation of the earing-promoting component from the sleeve takes place, whereby stirring of the developer component with the earing-promoting component is enhanced and separation of both the components is prevented, with the result that earing on the sleeve is further uniformalized.

It is preferred that the rotation speed of the sleeve be 100 to 500 rotations per minute. Adjacent poles S or N may be formed in one portion or at least two portions.

In accordance with still another embodiment of the present invention, there is provided a method of the development of an electrostatic image, which comprises arranging a developer-feeding sleeve having a magnet arranged in the interior thereof between the surface of a photosensitive drum carrying an electrostatic image thereon and a developer vessel for containing a developer therein, forming a magnetic brush on the sleeve from an earing-promoting component comprising particles of a dispersion of a powder of a magnetic material in a resin, which have a relatively large diameter of 70 to 300 microns, and a developer component comprising particles of a dispersion of a powder of a magnetic material in a binder medium, which have a relatively small particle diameter of 5 to 50 microns, rotating the sleeve, and stationarily arranging within the sleeve a magnet in which poles S and N are alternately arranged on the inner circumference of the sleeve and at least a portion within the developer vessel is not magnetized.

Figure 6:
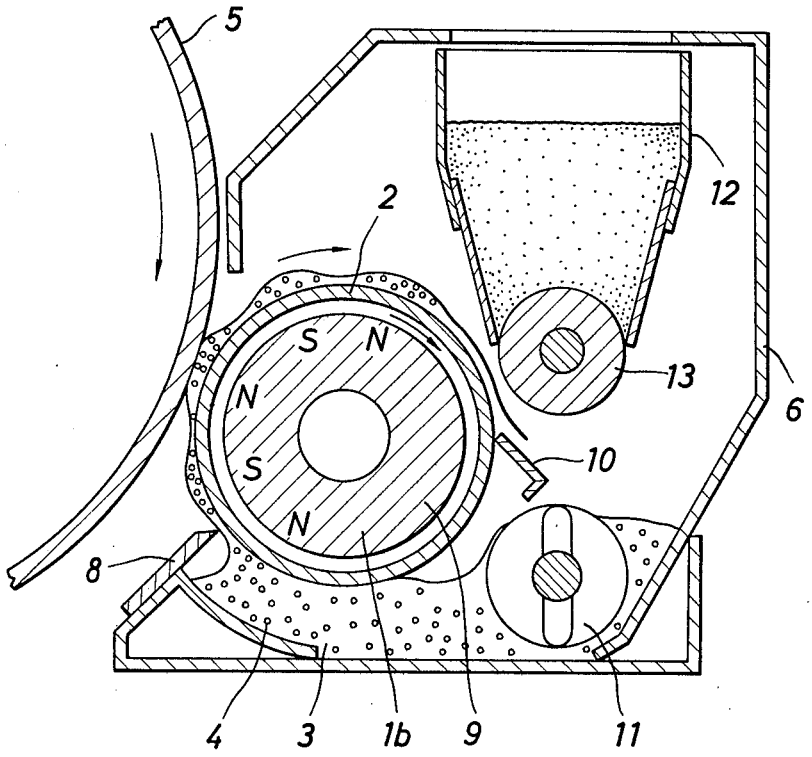
FIG. 6 is a diagram illustrating an embodiment in which the developer of the present invention comprising an earing-promoting component and a developer component is used for a developing apparatus in which a magnet having a non-magnetized portion is arranged.

This embodiment is illustrated in FIG. 6. The arrangement of the photosensitive drum, sleeve and vessel is substantially the same as in the embodiment shown in FIG. 3, but in the embodiment shown in FIG. 6 a sleeve 2 is rotatably arranged and a magnet 1*b* is stationarily arranged same as shown in FIG. 5. The excellent feature of this magnet 1*b* is that poles S and N are arranged alternately along the inner circumference of the sleeve and the magnet 1*b* has at least one portion 9 within the developer vessel that is not magnetized.

In a developer vessel 6, a scraping plate 10 having a top end contacted with a sleeve 2 is arranged in a non-magnetized portion 9, and a developer-stirring mechanism 11 is arranged on the discharge side of the scraping plate 10. A tank 12 for containing a developer component 3 alone therein is arranged in the developer vessel 6, and when supply of the developer component 3 is necessary, a feed roller 13 is rotated to supply the developer component 3 into the developer vessel 6.

In this embodiment of the present invention, the magnetic brush after the development is scraped down from the sleeve 2 into the vessel 6 by the scraping plate 10 in the non-magnetized portion of the magnet 1 and the earing-promoting component 4 and the developer component 3 are uniformly stirred by the stirring mechanism 11. The resulting homogeneous mixture is supplied onto the sleeve 2 again. Accordingly, in this embodiment, separation of the earing-promoting component 4 from the developer component 3 is effectively prevented. The rotation speed of the sleeve may be the same as that adopted in the embodiment shown in FIG. 5.

As will be apparent from the foregoing description, good earing of the magnetic brush of the magnetic developer can always be maintained irrespectively of changes of the environmental conditions such as the temperature, the humidity and the like, and an image having a good quality comparable to the quality of an image obtained in case of the one-component type developer can be obtained by a simple operation similar to the operation adopted in case of the one-component type developer.

The present invention will now be described in detail with reference to the following Examples that by no means limit the scope of the invention.

| Recipe and Preparation Process of Earing-Promoting Component | |
|---|---|
| Recipe (a): | |
| Pliolite VTL (vinvl toluene-butadiene copolymer supplied by Goodyear Tire and Rubber Co.) | 27 parts by weight |
| Viscol 550P (polypropylene wax supplied by Sanyo Kasei Kubushiki Kaisha) | 3 parts by weight |
| Printex L (carbon black supplied by Degussa Co.) | 0.1 part by weight |
| Black Iron B6 (triiron tetroxide supplied by Toyo Shikiso Kabushiki Kaisha) | 70 parts by weight |
| Recipe (b): | |
| Epikote 1004 (epoxy resin supplied by Shell Chemical Co.) | 50 parts by weight |
| Magnetic Iron Oxide RB-BL (triiron tetroxide supplied by Titanium Kogyo Kabushiki Kaisha) | 50 parts by weight |
| Recipe (c): | |
| Epikoto 1004 | 30 parts by weight |
| Zinc oxide powder | 20 parts by weight |
| Black Iron B6 | 50 parts by weight |

Preparation Process:

Materials of the recipe (a), (b) or (c) were molten and kneaded by a compression kneader, and the kneaded mixture was cooled and pulverized by a pin mill supplied by Arpine Co. By using a vibrating sieve, the pulverization product was classified to obtain earing-promoting component particles having a size of 75 to 150μ in case of the recipe (a), 104 to 295μ in case of the recipe (b) or 104 to 173μ in case of the recipe (c).

| Recipe and Preparation Process of Magnetic Developer Component | |
|---|---|
| Recipe (1): | |
| Arkon P-125 (hydrogenated styrene resin supplied by Arakawa Rinsan Kagaku Kogyo Kabushiki Kaisha) | 45 parts by weight |
| Nigrosine stearate (¼ weight ratio salt of Nigrosine/stearic acid) | 10 parts by weight |
| Amide AP-1 (fatty acid amide having a melting point of 98° C., supplied by Nippon Kasei Kabushiki Kaisha) | 25 parts by weight |
| Evaflex 420 (ethylene-vinyl acetate copolymer supplied by Mitsui Polychemical Kabushiki Kaisha) | 20 parts by weight |
| Special Black IV (carbon black supplied by Degussa Co.) | 12 parts by weight |
| Black Iron B6 (triiron tetroxide supplied by Toyo Shikiso Kabushiki Kaisha) | 250 parts by weight |

The above materials were incorporated in 1000 parts by weight of toluene with stirring, and they were dissolved and dispersed over a period of 30 minutes by using a homogenizing mixer. The resulting dispersion maintained at 70° C. was sprayed into hot air maintained at 150° C. to obtain spherical dry fine particles. Particles having a size of 5 to 15μ were collected by classification. To 100 parts by weight of the classified particles were added 0.5 part by weight of Printex L (carbon black) and 0.3 part by weight of Aerosil R972 (finely divided silica), and the resulting composition was homogeneously mixed by a Henschel mixer to obtain an electroconductive toner (1). The toner particles had an electric resistivity of $10^8$ Ω-cm.

| Recipe (2): | |
|---|---|
| Pliolite ACL (styrene-acrylic copolymer supplied by Goodyear Tire and Rubber Co.) | 14 parts by weight |
| Hi-Wax 200P (polyethylene wax supplied by Mitsui Polychemical Kabushiki Kaisha) | 31 parts by weight |
| Magnetic Iron Oxide RB-BL (triiron tetroxide supplied by Titanium Kogyo Kabushiki Kaisha) | 35 parts by weight |

The above materials were mixed and melt-kneaded by using a hot three-roll mill, and the kneaded mixture was cooled and finely pulverized by a jet mill. Particles having a size of 5 to 15μ were obtained by classification using an air classifier. Then, 2000 parts by weight of the classified fixing magnetic particles having a size of 5 to 15μ and 100 parts by weight of RB-BL (triiron tetroxide supplied by Titanium Kogyo Kabushiki Kaisha) were charged in a Henschel mixer, and the charge was stirred for 30 minutes at a rotation number of 1500 rpm while maintaining the interior temperature at 50° C. to embed triiron tetroxide in the surfaces of the fixing magnetic particles. Then, the mixer was cooled, and 80 parts by weight of triiron oxide and 10 parts by weight of Aerosil R972 were mixed with stirring at a rotation number of 1000 rpm for 5 minutes to obtain self-chargeable, pressure-fixing magnetic toner particles (2).

| Recipe (3): | |
|---|---|
| Pliolite ACL | 40 parts by weight |
| Viscol 550P | 5 parts by weight |
| Black Iron B6 | 55 parts by weight |

The above materials were mixed and melt-kneaded by using a hot three-roll mill, and the kneaded mixture was cooled and finely pulverized by a jet mill. Particles having a size of 5 to 15μ were collected by using an air classifier supplied by Arpine Co.

Then, 2000 parts by weight of the classified fixing magnetic particles having a size of 5 to 15μ and 60 parts by weight of RB-RL (triiron tetroxide) were charged in a Henschel mixer and stirred at a rotation number of 2000 rpm for 10 minutes while maintaining the interior temperature at 40° C. to form a mixture in which a part of triiron tetroxide was embedded in the surfaces of the fixing magnetic particles. The Henschel mixer was then cooled, and 10 parts by weight of Aerosil R972 was added and stirring was conducted at a rotation number of 1000 rpm for 5 minutes to obtain self-chargeable, heat-fixing magnetic toner particles (3).

EXAMPLE 1

Densi Copystar MC-20 (electronic copying machine supplied by Mita Industrial Co. Ltd.) which comprised an Se drum and a developing apparatus in which a magnet was rotated and a sleeve was kept stationary (developing apparatus shown in FIG. 3) and in which the ear-cutting clearance was 0.4 mm, the development distance was 0.70 mm and a copy was obtained by transferring a developed toner image on the Se drum onto a copy sheet was used as the copying machine.

At first, 7 g of the earing-promoting particles (c) were uniformly eared on the magnet sleeve, and 160 g of the magnet toner (1) was charged in the hopper and the developing apparatus was set to the copying machine. Thus, the copying operation was carried out continuously to obtain 5000 prints. When the 5000th print was compared with the first print with respect to the image density, fogging of the background and image uniformity, it was found that a good image could be obtained on the 5000th print stably without any change. Incidentally, transfer sheets which had been subjected to the insulating treatment were used. The quantity of the earing-promoting particles on the sleeve was 3 g, and the quantity of the particles of the magnetic toner (1) was 35 g. These quantities were not changed even after 5000 prints had been obtained.

COMPARATIVE EXAMPLE 1

The same copying machine as described in Example 1 was used, and the copying test was carried out while charging 100 g of the magnetic toner 1 in the hopper. At the time of start of the copying operation, the image density, fogging of the background and image uniformity were the same as in Example 1, but when 1000 prints were formed, reduction of the image density took place, and when 1500 prints were formed, the image uniformity was drastically degraded. Namely, low-density parts were observed here and there on the reproduced image, and it was found that the density of earing was locally reduced on the sleeve. It was confirmed that the temperature of the developing sleeve had been elevated to 35° C. from 25° C. and blocking of the toner particles was caused at the position of the ear-cutting plate. When the toner present in the vicinity of the ear-cutting plate was stirred by a spatula, the earing condition was improved and a print as good as the print obtained at the start of the copying operation was obtained again.

EXAMPLE 2

The same copying machine as described in Example 1 was used, and a developing apparatus in which both the magnet and the sleeve were rotated (developing apparatus shown in FIG. 4) was used under such conditions that the ear-cutting clearance was 0.3 mm and the development distance was 0.7 mm. At first, 5 g of the earing-promoting particles (a) were uniformly eared on the magnet sleeve, and 100 g of the magnetic toner (2) was charged in the hopper and the copying operation was carried out continuously to obtain 5000 prints. A plain paper (BM-65 supplied by Daishowa Seishi Kabushiki Kaisha) was used as the transfer sheet.

As in Example 1, the image density, fogging of the background and image uniformity were not changed even after 5000 prints had been obtained.

The quantity of the earing-promoting particles (a) on the sleeve was 2.5 g and the quantity of the magnetic toner (2) on the sleeve was 3 g, and these quantities were not changed even after 5000 prints had been obtained.

COMPARATIVE EXAMPLE 2

In the same manner as described in Example 2, the copying operation was carried out while charging 100 g of the magnetic toner (2) in the hopper.

The image density, fogging of the background and image uniformity at the start of the copying operation were the same as in Example 2. When about 1000 prints were obtained, fine white longitudinal streaks were formed on the image, and when about 1300 prints were obtained, these streaks were broadened and the number of the streaks was increased. When the earing state of the toner on the sleeve was examined, it was found that parts having no ears were present on the sleeve. Small masses of cellulose fibers were stuffed in the ear-cutting plate. If these small masses were removed, the earing condition was improved again and a print similar to the print obtained at the start of the copying operation was obtained. When about 500 prints were obtained after cleaning of the ear-cutting plate, formation of streaks was observed again.

EXAMPLE 3

The copying operation was carried out in a PPC copying machine provided with a heating roller fixing apparatus and an Se photosensitive drum (Denshi Copystar DC-161 suppled by Mita Industrial Co. Ltd.) by using a developing apparatus as shown in FIG. 6.

A developer formed by mixing 200 g of the earing-promoting particles (b) with 300 g of the magnetic toner (3) was uniformly eared on the sleeve of the developing apparatus, and 250 g of the magnetic toner (3) was charged in a toner-supplying hopper. The copying operation was carried out continuously at room temperature (the temperature of the developing zone was 35° to 38° C.) to obtain 30,000 prints. In this Example, the development bias was cut during the copying operation. The magnetic toner concentration on the sleeve was 60%. When the 30,000th print was compared with the first print, it was found that the image density, fogging of the background and image uniformity were not changed, and it was confirmed that the copying operation could be conducted stably. When 30,000 prints were obtained, the toner density on the sleeve was 62%.

COMPARATIVE EXAMPLE 3

In the same copying machine as used in Example 3, the copying operation was carried out by using the magnetic toner (3) alone while cutting the development bias. When the copying operation was started, the image density was high but fogging of the background was extreme, and when 100 prints were continuously formed, the untransferred toner was not cleared but accumulated on the drum and the drum was entirely contaminated black with the toner, with the result that no image could be formed.

EXAMPLE 4

The copying operation was carried out by using the same electronic copying machine as described in Example 3 and a developing apparatus as shown in FIG. 5. The earing clearance was 0.5 mm and the development distance was 0.9 mm.

At first, 10 g of the earing-promoting particles (c) were uniformly eared on the magnet sleeve, and 150 g of the magnetic toner (3) was charged in the hopper and the copying operation was carried out continuously to obtain 30,000 prints. A plain paper (BM-65 supplied by Daishowa Seishi Kabushiki Kaisha) was used as a transfer sheet.

While 30,000 prints were obtained, the image density, fogging of the background and image uniformity were not changed at all. The quantity of the earing-promoting particles (c) on the sleeve was 5 g and the quantity of the magnetic toner (3) on the sleeve was 10 g, and these quantities were not changed even after 5000 prints had been obtained.

COMPARATIVE EXAMPLE 4

The copying operation was carried out continuously by using the same copying machine and developing apparatus as used in Example 4 and using the magnetic toner (3) alone. Copies having a good image density were obtained when the copying operation was conducted 5000 times continuously. However, when the copying operation was carried out after standing overnight, the image density was partially reduced in obtained copies and it was confirmed that blurring took place. When the developing apparatus was taken out and examined, it was found that blocking of the magnetic toner was locally caused in the ear-cutting plate.

The image density and fog density were measured with respect to copies obtained in Examples 1 through 4 and Comparative Examples 1 through 4. The obtained results are shown in Table 2. Incidentally, the density was measured by using a densitometer, Sakura Model PDA65 (supplied by Konishiroku Shashin Kogyo Kabushiki Kaisha).

TABLE 2

| | First Print | | 1000th Print | | 5000th Print | | 30000th Print | |
|---|---|---|---|---|---|---|---|---|
| | Image Density | Fog Density | Image Density | Fog Density | Image Density | Fog Density | Image Density | Fog Density |
| Example 1 | 1.30 | 0.01 | 1.30 | 0.01 | 1.28 | 0.01 | | |
| Comparative Example 1 | 1.30 | 0.01 | 1.00 | 0.01 | | | | |
| Example 2 | 1.55 | 0.01 | 1.55 | 0.01 | 1.60 | 0.01 | | |
| Comparative Example 2 | 1.55 | 0.01 | 1.50 | 0.01 | | | | |
| Example 3 | 1.60 | 0.01 | 1.60 | 0.01 | 1.58 | 0.01 | 1.55 | 0.01 |
| Comparative Example 3 | 1.60 | 0.01 | | | | | | |
| Example 4 | 1.58 | 0.01 | 1.60 | 0.01 | 1.60 | 0.01 | 1.59 | 0.01 |
| Comparative Example 4 | 1.49 | 0.01 | 1.50 | 0.01 | 1.48 | 0.01 | | |

What is claimed is:

1. A method of developing an electrostatic image by bringing an electrostatic image-carrying surface of a substrate into sliding contact with a magnetic brush of a developer formed on a developer-feeding sleeve having a magnet arranged in the interior thereof, wherein the magnetic brush is formed from (A) an earing-promoting component comprising particles of a dispersion of a powder of a magnetic material in a resin, which have a relatively large diameter of 70 to 300 microns, the magnetic material being present in an amount of 30 to 80% by weight based on the total weight of the resin and the magnetic material and (B) a developer component comprising particles of a dispersion of a powder of a magnetic material in a binder medium, which have a relatively small diameter of 5 to 50 microns, the magnetic material being present in the developer component in an amount of 40 to 75% by weight based on the total weight of the resin and the magnetic material, and the ratio of the earing-promoting component to the developer component being within the range of 80:20 to 10:90, and wherein the electrostatic image is developed only by the developer component.

2. A method of developing an electrostatic image, which comprises arranging a developer-feeding sleeve having a magnet arranged in the interior thereof between the surface of a photosensitive drum carrying an electrostatic image thereon and a developer vessel for containing a developer therein, forming a magnetic brush on the sleeve from (A) an earing-promoting component comprising particles of a dispersion of a powder of a magnetic material in a resin, which have a relatively large diameter of from 70 to 300 microns, the magnetic material being preent in an amount of 30 to 80% by weight based on the total weight of the resin and the magnetic material and (B) a developer component comprising particles of a dispersion of a powder of a magnetic material in a binder medium, which have a relatively small diameter of from 5 to 50 microns, the magnetic material being present in the developer component in an amount of 40 to 75% by weight based on the total weight of the resin and the magnetic material, and the ratio of the earing-promoting component to the developer component being within the range of 80:20 to 10:90, rotating the magnet arranged in the interior of the sleeve to bring the electrostatic image-carrying surface into sliding contact with the magnetic brush and developing the electrostatic image only by the developer component.

3. A method according to claim 2, wherein the sleeve is kept stationary and the magnet arranged in the interior of the sleeve is rotated in the same direction as the rotation direction of the photosensitive drum.

4. A method according to claim 2, wherein the sleeve is rotated in the direction opposite to the rotation direction of the magnet arranged in the interior of the sleeve.

5. A method of developing an electrostatic image, which comprises arranging a developer-feeding sleeve having a magnet arranged in the interior thereof between the surface of a photosensitive drum carrying an electrostatic image thereon, forming a magnetic brush on the sleeve from (A) an earing-promoting component comprising particles of a dispersion of a powder of a magnetic material in a resin, which have a relatively large diameter of 70 to 300 microns, the magnetic material being present in an amount of 30 to 80% by weight based on the total weight of the resin and the magnetic material and (B) a developer component comprising particles of a dispersion of a powder of a magnetic material in a binder medium, which have a relatively small diameter of 5 to 50 microns, the magnetic material being present in the developer component in an amount of 40 to 75% by weight based on the total weight of the resin and the magnetic material, and the ratio of the earing-promoting component to the developer component being within the range of 80:20 to 10:90, rotating the sleeve, and arranging stationarily within the sleeve an asymmetric magnetic in which poles S and N are alternately arranged on the inner circumference of the sleeve and poles S or N are arranged adjacently to each other at a position other than the developer-feeding portion thereby to bring the electrostatic image-carrying surface into sliding contact with the magnetic brush and developing the electrostatic image by the developer component.

6. A method of developing an electrostatic image, which comprises arranging a developer-feeding sleeve having a magnet arranged in the interior thereof between the surface of a photosensitive drum carrying an electrostatic image thereon and a developer vessel for containing a developer therein, forming a magnetic brush on the sleeve from (A) an earing-promoting component comprising particles of a dispersion of a powder of a magnetic material in a resin, which have a relatively large diameter of 70 to 300 microns, the magnetic material being present in an amount of 30 to 80% by weight based on the total weight of the resin and the magnetic material and (B) a developer component comprising particles of a dispersion of a powder of a magnetic material in a binder medium, which have a relatively small diameter of 5 to 50 microns, the magnetic material being present in the developer component in an amount of 40 to 75% by weight based on the total weight of the resin and the magnetic material, and the ratio of the earing-promoting component to the developer component being within the range of 80:20 to 10:90, rotating the sleeve, and stationarily arranging within the sleeve a magnet in which poles S and N are alternately arranged on the inner circumference of the sleeve and at least a portion within the developer vessel is not magnetized, thereby to bring the electrostatic image-carrying surface into sliding contact with the magnetic brush and developing the electrostatic image by the developer component.

7. A method according to claim 1, 2, 5 or 6, wherein the earing-promoting component and the developer component are present on the sleeve at a weight ratio of from 65/35 to 20/80.

8. A method according to claim 1, 2, 5 or 6, wherein the earing-promoting component comprises particles having an electric resistivity of $10^7$ to $10^{14}$ Ω-cm.

9. A method according to claim 1, 2, 5 or 6 wherein the developer component comprises particles having a relatively small diameter of 5 to 15 microns.

* * * * *